US006469609B2

(12) United States Patent
Lee et al.

(10) Patent No.: US 6,469,609 B2
(45) Date of Patent: Oct. 22, 2002

(54) METHOD OF FABRICATING SILVER INDUCTOR

(75) Inventors: Seung-Yun Lee, Seoul; Jin-Yeong Kang, Taejon, both of (KR)

(73) Assignee: Electronics and Telecommunications Research Institute, Taejon (KR)

( * ) Notice: Subject to any disclaimer, the term of this patent is extended or adjusted under 35 U.S.C. 154(b) by 0 days.

(21) Appl. No.: 09/733,839

(22) Filed: Dec. 7, 2000

(65) Prior Publication Data

US 2002/0105405 A1 Aug. 8, 2002

(30) Foreign Application Priority Data

Jan. 28, 2000 (KR) ..... 2000-4142

(51) Int. Cl.[7] ..... H01F 5/00

(52) U.S. Cl. ..... 336/200; 336/223; 336/232; 29/605; 29/602.1

(58) Field of Search ..... 336/200, 232, 336/212, 223; 438/381; 257/752; 29/605, 606, 602.1

(56) References Cited

U.S. PATENT DOCUMENTS

| | | | | |
|---|---|---|---|---|
| 5,478,773 A | | 12/1995 | Dow et al. | 437/60 |
| 6,153,489 A | * | 11/2000 | Park et al. | 438/381 |
| 6,157,081 A | * | 12/2000 | Nariman et al. | 257/752 |
| 6,287,931 B1 | * | 9/2001 | Chen | 438/381 |

OTHER PUBLICATIONS

C. Patrick Yue et al., "On–Chip Spiral Inductors with Patterned Ground Shields for Si–Based RF IC's", IEEE, 1998, pp. 743–752.

Joachim N. Burghartz et al., "Microwave Inductors and Capacitors in Standard Multilevel Interconnect Silicon Technology", IEEE, 1996, pp. 100–104.

Min Park et al., "The Detailed Analysis of High Q CMOS–Compatible Microwave Spiral Inductors in Silicon Technology", IEEE, 1998, pp. 1953–1959.

Kirk B. Ashby et al., "High Q Inductors for Wireless Applications in a Complementary Silicon Bipolar Process", IEEE, 1996, pp. 4–9.

J.N. Burghartz et al., "monolithic Spiral Inductors Fabricated Using a VLSI Cu–Damascene Interconnect Technology and Low–Loss Substrates", IEEE, 1996, pp. 45.1–45.4.

Nhat M. Nguyen et al., "Si IC–Compatible Inductors and LC Passive Filters", IEEE, 1990, pp. 1028–1031.

* cited by examiner

*Primary Examiner*—Anh Mai
(74) *Attorney, Agent, or Firm*—SEED IP Law Group PLLC

(57) ABSTRACT

The present invention relates to a method of fabricating an inductor capable of improving a quality factor and decreasing a series resistance by using as a material of the inductor silver smaller in a specific resistance than aluminum used conventionally. The method of fabricating an inductor according to the present invention includes the following steps. A first step is of forming a first metal layer on a first insulating layer, patterning said first metal layer, and forming a second insulating layer on the resultant structure. A second step is of patterning said second insulating layer to form a via hole and forming a plug in said via hole. A third step is of forming a third insulating layer on the resultant structure and patterning said third insulating layer to form a spiral groove. A fourth step is of forming a second metal layer in said spiral groove to form an inductor. And a fifth step is of forming a fourth insulating layer for protecting said inductor from a mechanical force or materials causing a chemical reaction.

13 Claims, 2 Drawing Sheets

METHOD OF FABRICATING SILVER INDUCTOR

TECHNICAL FIELD

The present invention relates to a method of fabricating a spiral inductor required for embodiment of RF integrated circuits. More particularly, the present invention relates to a method of fabricating an inductor capable of improving a quality factor and decreasing a series resistance by using as a material of the inductor silver smaller in a specific resistance than aluminum used conventionally.

BACKGROUND OF THE INVENTION

Passive elements such as inductors, capacitors, resistors and the like are necessary for construction of integrated circuits, ICs. The passive elements are separately mounted on a circuit board or are integrated on a semiconductor substrate by batch processes.

The latter methods have an advantage that a size of the integrated circuit can be greatly reduced, and one of the latter methods is illustrated in FIG. 1, in which an inductor is fabricated by forming a spiral metal interconnection 2 on a semiconductor substrate.

In such a conventional method of forming the spiral inductor, as shown in FIG. 2, a multi-layer structure is formed such that an insulating layer 4 is formed on a semiconductor substrate 3 and a first metal interconnection of aluminum layer 5 is formed thereon.

Next, the aluminum layer is patterned, an insulating layer 6 is formed thereon, the insulating layer 6 is patterned to form a via hole, and then the via hole is plugged 7.

Next, a second metal interconnection of aluminum layer 8 is formed on the resultant structure, the aluminum layer is patterned and an insulating layer 9 is formed on the whole surface, thereby fabricating the spiral inductor.

In order to improve the adhesion characteristics of the metal layer or in order to prevent the metal from being diffused into the semiconductor substrate and the insulating layer, titanium Ti and titanium nitride TiN or titanium tungsten TiW layers may be formed, before or after forming the metal layer.

Because the quality factor Q of an inductor is in inverse proportion to series resistance of the metal line, the spiral inductor made of aluminum could not provide a good quality factor and thus, there is a problem that such spiral inductor is not suitable for the integrated circuit operating at high frequency.

On the other hand, it is known that the inductor made of silver having a lower resistance than aluminum is capable of having the decreased series resistance of the inductor itself. However, it is difficult to fabricate a fine spiral metal line using silver, so that an inductor made of silver could not have been embodied up to now.

SUMMARY OF THE INVENTION

Therefore, the present invention is made in order to solve the aforementioned problems.

An object of the present invention is to provide a method of fabricating an inductor suitable for integrated circuits operating at high frequency, using silver in place of the conventional aluminum and capable of decreasing a series resistance and improving a quality factor thereof.

The above object can be accomplished by a method of fabricating an inductor using silver according to the present invention. The method includes the following steps. A first step is of forming a first metal layer on a first insulating layer, patterning said first metal layer, and forming a second insulating layer on the resultant structure. A second step is of patterning said second insulating layer to form a via hole and forming a plug in said via hole. A third step is of forming a third insulating layer on the resultant structure and patterning said third insulating layer to form a spiral groove. A fourth step is of forming a second metal layer in said spiral groove to form an inductor. And a fifth step is of forming a fourth insulating layer for protecting said inductor from a mechanical force or materials causing a chemical reaction.

It is preferable that said fourth step includes a step of successively forming a diffusion barrier layer for preventing said second metal layer from being diffused and a seed layer for facilitating formation of said second metal layer in said spiral groove, before formation of said second metal layer, thereby a multi-layer of said diffusion barrier layer, said seed layer and said second metal layer constitutes a metal line of said inductor.

Also, it is preferable that said diffusion barrier layer includes Ti/TiN alloy or Ti/TiW alloy.

Also, it is preferable that said seed layer includes a silver (Ag) or a palladium (Pd).

Preferably, said first metal layer includes an aluminum layer, said plug includes an aluminum or a tungsten, and said second metal layer includes a silver layer or a silver alloy layer.

More preferably, said second metal layer is formed by a sputtering or an electroplating method.

Most preferably, the method further includes a step of reflowing said second metal layer by heat treatment.

It is still more preferable that a temperature of said heat treatment is within a range of 300~500 centigrade and the heat treatment is performed in an ambient of oxygen or halogen gas. Also, it is still more preferable that the method further includes a step of heat treating said second metal layer in an ambient of hydrogen gas to remove said oxygen or halogen gas existing in said second metal layer.

Also, according to the present invention, an inductor is provided. The inductor includes the following elements: a semiconductor substrate; a first insulating layer formed on said semiconductor substrate; a first metal layer formed on a predetermined region of said first insulating layer; a second insulating layer formed on said first metal layer and said first insulating layer; wherein said second insulating layer has a via hole to expose said first metal layer; a plug layer formed in said via hole; a third insulating layer formed on said second insulating layer and said plug layer, wherein said third insulating layer has a spiral groove; a second metal layer formed in said spiral groove, wherein said second metal layer includes a silver layer or a silver layer alloy layer; and a fourth insulating layer formed on said second metal layer and said third insulating layer.

Preferably, the inductor further comprises a diffusion barrier layer and a seed layer formed between said third insulating layer and said second metal layer in said spiral groove.

According to the aforementioned present invention, because silver smaller in a specific resistance than the conventional aluminum can be used as a material of an inductor, a quality factor of the spiral inductor can be improved and a series resistance of the spiral inductor can be greatly decreased. Therefore, a spiral inductor according to the present invention is suitable for the integrated circuit operating at high frequency.

BRIEF DESCRIPTION OF THE DRAWINGS

The embodiments of the present invention will be explained with reference to the accompanying drawings, in which.

DETAILED DESCRIPTION OF THE INVENTION

The above object, other objects, features and advantages of the present invention will be better understood from the following description taken in conjunction with the attached drawings.

Now, preferred embodiments of the present invention will be de scribed in detail with reference to the drawings.

Figure 1:
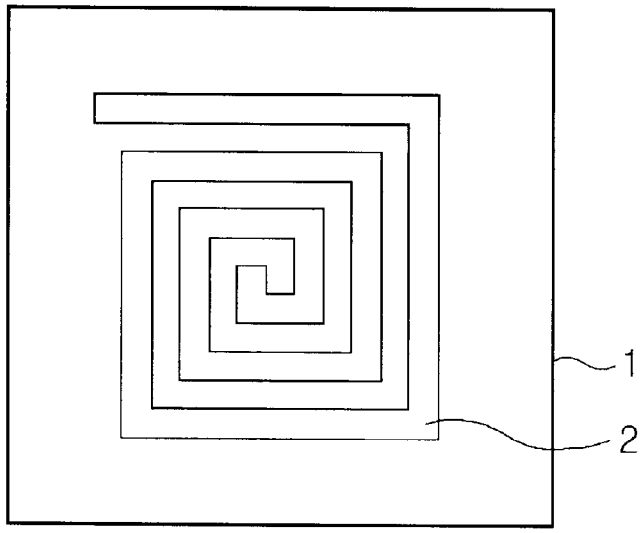
FIG. 1 is a plan view of a general spiral inductor.
Figure 2:
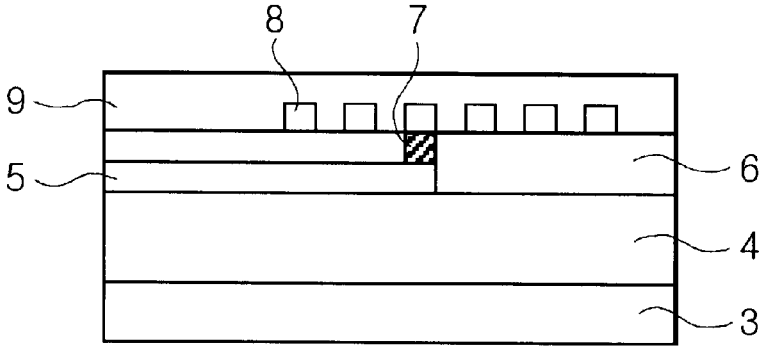
FIG. 2 is a cross-sectional view of the general spiral inductor shown in FIG. 1.
Figure 3:
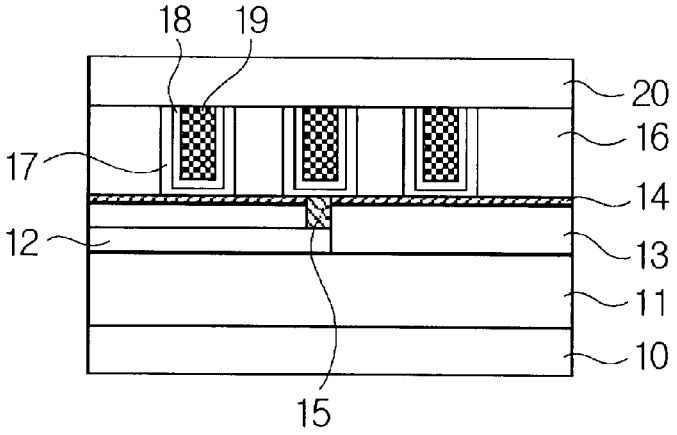
FIG. 3 is a cross-sectional view of a spiral inductor according to the present invention.

FIG. 3 is a cross-sectional view of a spiral inductor made of silver according to an embodiment of the present invention, which is fabricated as followings.

First, a first insulating layer 11 is formed on a semiconductor substrate 10. The insulating layer 11 is necessary for preventing charge loss through the semiconductor substrate and is made of insulator such as silicon dioxide.

An aluminum layer 12 to be a first metal interconnection is formed on the first insulating layer 11 and is patterned, and a second insulating layer 13 and a third insulating layer 14 are successively formed thereon.

Subsequently, the second insulating layer 13 and the third insulating layer 14 are patterned to form a via hole, and the via hole is plugged with aluminum or tungsten 15. That is, a plug is formed.

A fourth insulating layer 16 is formed on the resultant structure and is patterned to form a spiral groove. A depth of the groove is several micrometer (em), so that even if a width of the groove and a space between the grooves are narrow, a lower resistance and a high quality factor can be maintained and an inductance per unit area can be increased. Also, the third insulating layer 14 and the fourth insulating layer 16 are made of materials having etching selectivity to each other, in which the third insulating layer 14 serves as an etch stop layer in etching the fourth insulating layer 16. For example, if the fourth insulating layer 16 is made of silicon oxide, the third insulating layer 14 is made of silicon nitride.

Titanium Ti and titanium nitride TiN or titanium tungsten TiW are formed in the spiral groove as a diffusion barrier layer 17 whose thickness is tens nanometer (nm), and then a seed layer 18 for silver plating whose thickness is tens nanometer (nm) is formed thereon by sputtering. The seed layer is made of silver (Ag) or palladium (Pd).

A silver or silver alloy layer 19 for a second metal interconnection is formed on the seed layer 18 by using sputtering or electroplating. Because silver has the lowest specific resistance (resistivity) and its cost is 60% of aluminum's, use of silver enables a series resistance of an inductor to be decreased and a quality factor to be increased. The resistivities of silver and aluminum are 1.59 $\mu\Omega\cdot$cm and 2.65 $\mu\Omega\cdot$cm, respectively. In electroplating, the diffusion barrier layer 17 and the seed layer 18 serve as a cathode and silver cations are coupled with electrons to reduce to solid silver. Silver is easily electroplated and thus silver layer having several micrometer ($\mu$m) of thickness can be formed for a short time.

Here, a multi-layer consisting of the diffusion barrier layer 17, the seed layer 18 and the silver or silver alloy layer 19 can be used as a metal line of an inductor.

According to the present invention, unlike the case of the conventional aluminum layer, silver layer is not directly patterned but the grooves formed in the insulating layer is plugged with silver, because silver cannot be dry-etched so that a fine metal line could not be formed by patterning.

A successive metal line without void can be fabricated by a heat treatment at low temperature within a range of 300~500 centigrade after silver layer 19 is formed. It is more preferable that the temperature in the heat treatment is within a range of 400~450 centigrade.

In general, a thin layer formed on a groove does not fill the groove completely. Or the thin layer may include a void. At that time, application of heat energy causes reflow due to displacement of atoms and thus the groove is filled with silver completely. In reflowing, a heat treatment is performed in an ambient of oxygen or halogen gas, at a temperature range not affecting other elements.

Figure 4:
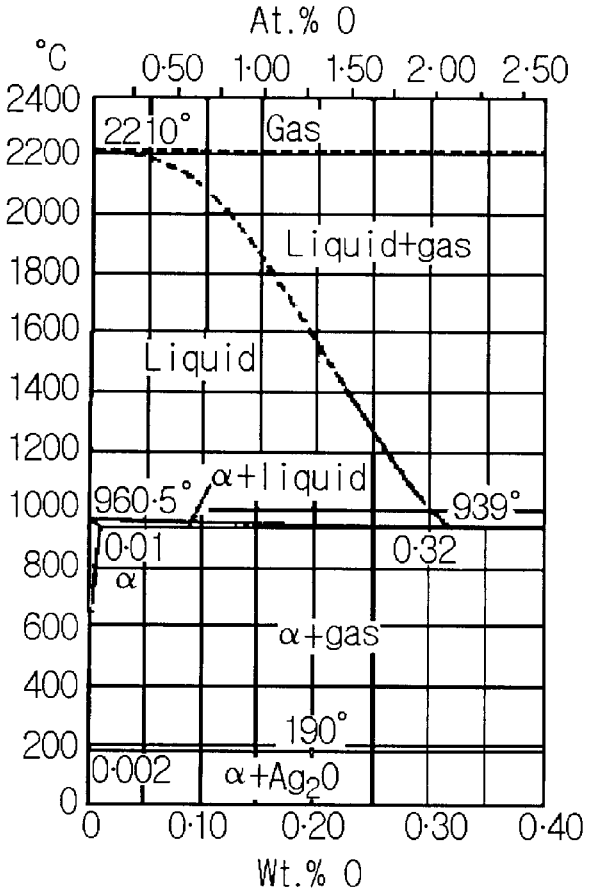
FIG. 4 is a drawing showing phase equilibriums of silver and oxygen.

As shown in FIG. 4 which illustrates phase equilibriums of silver and oxygen, because silver oxide is thermodynamically unstable at temperatures equal to or greater than 190 centigrade, silver oxide is not formed at those temperatures. A little of oxygen dissolved in silver lattice is removed by heat treatment in an ambient of hydrogen gas, after the reflow.

Finally, a fifth insulating layer 20 is formed on the whole surface to protect the silver inductor from mechanical force or materials causing chemical reaction. When it is required that other elements is integrated on the silver inductor, the fifth insulating layer 20 is formed after planarization by Chemical Mechanical Polishing (CMP).

According to the aforementioned present invention, an inductor can be fabricated using a silver which is metal having a lower resistance, so that a series resistance of the inductor itself can be decreased and a quality factor thereof can be improved. Also, because a metal line having a high aspect ratio is formed using electroplating of which the forming speed is high, inductance per unit area can be increased without loss of resistance and quality factor characteristics. Because defects in the metal line due to electroplating are removed by reflow process, the spiral inductor according to the present invention has better characteristics.

Therefore, improvement of the inductor according to the present invention enables RF integrated circuits operating at high frequency to be realized, and decrease in area of the inductor enables a semiconductor device integrated in high density to be realized.

Although technical spirits of the present invention has been disclosed with reference to the appended drawings and the preferred embodiments of the present invention corresponding to the drawings has been described, descriptions in the present specification are only for illustrative purpose, not for limiting the present invention.

Also, those who are skilled in the art will appreciate that various modifications, additions and substitutions are possible without departing from the scope and spirit of the present invention. Therefore, it should be understood that the present invention is limited only to the accompanying claims and the equivalents thereof, and includes the aforementioned modifications, additions and substitutions.

What is claimed is:

1. A method of fabricating an inductor, comprising:

a first step of forming a first metal layer on a first insulating layer formed on a semiconductor substrate, patterning said first metal layer, and forming a second insulating layer on the first metal layer;

a second step of patterning said second insulating layer to form a via hole and forming a plug in said via hole;

a third step of forming a third insulating layer on the structure formed in the second step and patterning said third insulating layer to form a spiral groove;

a fourth step of forming a second metal layer in said spiral groove to form an inductor, said fourth step including a step of successively forming a diffusion barrier layer for preventing said second metal layer from being diffused and a seed layer for facilitating formation of said second metal layer in said spiral groove, before formation of said second metal layer, thereby a multi-layer of said diffusion barrier layer, said seed layer and said second metal layer constitutes a metal line of said inductor; and a fifth step of forming a fourth insulating layer for protecting said inductor from a mechanical force or materials causing a chemical reaction.

2. The method of fabricating an inductor according to claim 1, further comprising a step of forming an insulating layer having an etch selectivity to said third insulating layer after said first step, wherein said insulating layer is patterned along with said second insulating layer in said second step.

3. The method of fabricating an inductor according to claim 1, wherein said diffusion barrier layer includes titanium and titanium nitride alloy Ti/TiN or titanium and titanium tungsten alloy Ti/TiW.

4. The method of fabricating an inductor according to claim 1, wherein said seed layer includes a silver or a palladium.

5. The method of fabricating an inductor according to claim 1, wherein said first metal layer includes an aluminum layer.

6. The method of fabricating an inductor according to claim 1, wherein said plug includes an aluminum or a tungsten.

7. The method of fabricating an inductor according to claim 1, wherein said second metal layer includes a silver layer or a silver alloy layer.

8. The method of fabricating an inductor according to claim 1, wherein said second metal layer is formed by a sputtering method or an electroplating method.

9. The method of fabricating an inductor according to claim 8, further comprising a step of reflowing said second metal layer by a heat treatment.

10. The method of fabricating an inductor according to claim 9, wherein a temperature of said heat treatment is within a range of 300~500 centigrade.

11. The method of fabricating an inductor according to claim 9, wherein said heat treatment is performed in an ambient of oxygen or halogen gas.

12. The method of fabricating an inductor according to claim 11, further comprising a step of heat treating said second metal layer in an ambient of hydrogen gas to remove said oxygen or halogen gas existing in said second metal layer.

13. An inductor, comprising:

a semiconductor substrate;

a first insulating layer formed on said semiconductor substrate;

a first metal layer formed on a predetermined region of said first insulating layer;

a second insulating layer formed on said first metal layer and said first insulating layer; wherein said second insulating layer has a via hole to expose said first metal layer;

a plug layer formed in said via hole;

a third insulating layer formed on said second insulating layer and said plug layer, wherein said third insulating layer has a spiral groove;

a second metal layer formed in said spiral groove, wherein said second metal layer includes a silver layer or a silver layer alloy layer;

a fourth insulating layer formed on said second metal layer and said third insulating layer; and a diffusion barrier layer and a seed layer formed between said third insulating layer and said second metal layer in said spiral groove.

* * * * *